US008372217B2

(12) United States Patent
Hasegawa et al.

(10) Patent No.: US 8,372,217 B2
(45) Date of Patent: Feb. 12, 2013

(54) IRON-BASED HIGH SATURATION MAGNETIC INDUCTION AMORPHOUS ALLOY CORE HAVING LOW CORE AND LOW AUDIBLE NOISE

(75) Inventors: Ryusuke Hasegawa, Morristown, NJ (US); Daichi Azuma, Myrtle Beach, SC (US)

(73) Assignees: Metglas, Inc., Conway, SC (US); Hitachi Metals, Ltd., Tokyo (JP)

( * ) Notice: Subject to any disclaimer, the term of this patent is extended or adjusted under 35 U.S.C. 154(b) by 0 days.

(21) Appl. No.: 12/654,763

(22) Filed: Dec. 31, 2009

(65) Prior Publication Data

US 2010/0175793 A1 Jul. 15, 2010

Related U.S. Application Data

(63) Continuation-in-part of application No. 11/320,744, filed on Dec. 30, 2005, which is a continuation-in-part of application No. 11/059,567, filed on Feb. 17, 2005, now abandoned.

(51) Int. Cl.
*H01F 1/153* (2006.01)

(52) U.S. Cl. ..... 148/304; 148/403; 420/99; 420/117; 420/121

(58) Field of Classification Search ..... None
See application file for complete search history.

(56) References Cited

U.S. PATENT DOCUMENTS

| | | | | |
|---|---|---|---|---|
| 4,142,571 | A | | 3/1979 | Narasimhan |
| 4,217,135 | A | | 8/1980 | Luborsky et al. |
| 4,219,355 | A | | 8/1980 | DeCristofaro et al. |
| 4,226,619 | A | | 10/1980 | Hatta et al. |
| 4,249,969 | A | | 2/1981 | DeCristofaro et al. |
| 4,298,409 | A | | 11/1981 | DeCristofaro et al. |
| 4,300,950 | A | | 11/1981 | Luborsky et al. |
| 4,437,907 | A | | 3/1984 | Sato et al. |
| 4,763,030 | A | | 8/1988 | Clark et al. |
| 4,865,664 | A | | 9/1989 | Sato et al. |
| 4,889,568 | A | | 12/1989 | Datta et al. |
| 5,593,513 | A | * | 1/1997 | Ramanan et al. ..... 148/304 |
| 5,593,518 | A | | 1/1997 | Ramanan |
| 6,420,042 | B1 | | 7/2002 | Sakamoto et al. |

FOREIGN PATENT DOCUMENTS

| | | | |
|---|---|---|---|
| EP | 0 049 770 | A2 | 4/1982 |
| EP | 1 615 241 | A2 | 1/2006 |
| JP | 59-150415 | * | 8/1984 |
| JP | 05-140703 | * | 5/1993 |
| JP | 9 129430 | A | 5/1997 |
| JP | 9-202946 | A | 8/1997 |
| JP | 10-280034 | A | 10/1998 |
| JP | 2006-45662 | | 2/2006 |

OTHER PUBLICATIONS

U.S. Appl. No. 11/059,567, filed Feb. 17, 2005, R. Hasegawa, et al., Metglas, Inc. and Hitachi Metals, Ltd.

U.S. Appl. No. 11/320,744, filed Dec. 30, 2005, R. Hasegawa, et al., Metglas Inc. and Hitachi Metals, Ltd.

(Continued)

*Primary Examiner* — John Sheehan

(57) ABSTRACT

A magnetic core having an iron-based amorphous alloy that includes: a chemical composition with a formula $Fe_aB_bSi_cC_d$, where $81.5<a\leqq84$, $12<b<17$, $1\leqq c<5$ and $0.3\leqq d\leqq1.0$, numbers being in atomic percent, with incidental impurities, simultaneously having a value of a saturation magnetic induction equal to or exceeding 1.63 tesla, a Curie temperature greater than or equal to 315° C. and less than or equal to 360° C. and a crystallization temperature greater than or equal to 400° C. and less than or equal to 470° C. The core has low core loss and exciting power and is suited for transformers, electrical chokes, power inductors and pulse generation and compression devices.

15 Claims, 9 Drawing Sheets

OTHER PUBLICATIONS

PCT Notification of Transmittal of the International Search Report and the Written Opinion of the International Searching Authority, or the Declaration dated Jul. 31, 2006, Form PCT ISA 220, (2 pgs) (in English).
PCT International Search Report dated Jul. 31, 2006, Form PCT ISA 210, (3 pgs) (in English).
PCT Written Opinion of the International Search Authority dated Jul. 31, 2006, From PCT ISA 237, (5 pgs) (in English).
PCT Notification of Transmittal of International Preliminary Examination Report dated Dec. 26, 2006, Form PCT/IPEA/416, 1 page (in English) .
PCT International Preliminary Examination Report dated Nov. 28, 2006, Form PCT/IPEA/409, 3 pages (in English).
Office Action mailed Jun. 27, 2009 in parent U.S. Appl. No. 11/320,744.
Office Action mailed Nov. 29, 2007 in parent U.S. Appl. No. 11/320,744.
Office Action mailed Jun. 9, 2008 in parent U.S. Appl. No. 11/320,744.
Moskowitz, Bruce E., "Fundamental Physical Constants and Conversion Factors", Global Earth Physics, A Handbook of Physical constants pp. 346 to 355, No Publication date available, downloaded from www.argu.org/reference/dephys/23_moskowitz.pdf.
Office Action mailed Jan. 8, 2009 in parent U.S. Appl. No. 11/320,744.
P.R. China First Office Action, issued Oct. 17, 2008 (8 pages) in English.
Office Action mailed Jun. 8, 2009 in parent U.S. Appl. No. 11/320,744.
Chinese Office Action issued Jun. 5, 2009 in corresponding Chinese Patent Application 200680011190.0.
Office Action mailed Nov. 25, 2009 in parent U.S. Appl. No. 11/320,744.
F.E. Luborsky, Ph.D., "Amorphous Metallic Alloys", Butterworth Monograph in Materials, Corporate Research and Development Center, General Electric Co., Schenectady, USA, Attachment A, Chapter 20 pp. 381, 397-400 and Attachment B pp. 2837-2839.
Ryusuke Hasegawa, Ph.D. "Glassy Metals: Magnetic, Chemical, and Structural Properties", Meterials Laboratory Corporate Research and Development Center Allied Corporation Morristown, New Jersey, pp. 183-189.
English Translation of the Chinese Office Action issued Aug. 13, 2010 in corresponding Chinese Patent Application 200680011190.0.
European Search Report issued on May 13, 2011 in corresponding European Patent Application No. 06 735 368.0-1215.
Japanese Office Action issued Apr. 21, 2011 in corresponding Japanese Patent Application 2007-556329.
Office Action issued in co-pending U.S. Appl. No. 11/320,744 mailed, Dec. 8, 2011.
Korean Office Action issued Oct. 22, 2012 in corresponding Korean Patent Application No. 10-2007-7019653.

* cited by examiner

IRON-BASED HIGH SATURATION MAGNETIC INDUCTION AMORPHOUS ALLOY CORE HAVING LOW CORE AND LOW AUDIBLE NOISE

CROSS-REFERENCE TO RELATED APPLICATIONS

This application is a continuation-in-part application of, and claims priority benefit under 35 U.S.C. §120 to, U.S. application Ser. No. 11/320,744 filed Dec. 30, 2005, which in turn is a continuation-in-part application of, and claims priority benefit under 35 U.S.C. §120 to U.S. application Ser. No. 11/059,567 filed Feb. 17, 2005 now abandoned, the disclosure of these applications are incorporated herein by reference.

BACKGROUND

1. Field

This invention relates to an iron-based amorphous alloy core with a saturation magnetic induction exceeding 1.6 Tesla and adapted for use in magnetic devices which require a low magnetic loss and a low level of audible noises during their operation, including transformers, motors and generators, pulse generators and compressors, magnetic switches, and magnetic inductors for chokes and energy storage.

2. Description of the Related Art

Iron-based amorphous alloys have been utilized in electrical utility transformers, industrial transformers, in pulse generators and compressors based on magnetic switches, electrical chokes and energy-storing power inductors. In electrical utility and industrial transformers, iron-based amorphous alloys exhibit no-load or core loss which is about ¼ that of a conventional silicon-steel widely used for the same applications operated at an AC frequency of 50/60 Hz. Since these transformers are in operation 24 hours a day, the total transformer loss worldwide may be reduced considerably by using such magnetic devices. The reduced loss means less energy generation, which in turn translates into reduced $CO_2$ emission.

For example, according to a recent study conducted by the International Energy Agency in Paris, France, an estimate for energy savings in the Organization for Economic Co-operation and Development (OECD) countries alone that would occur by replacing all existing silicon-steel based units was about 150 terawatt-hours (TWh) in year 2000, which corresponds to about 75 million ton/year of $CO_2$ gas reduction. The transformer core materials based on the existing iron-rich amorphous alloys have saturation inductions $B_s$ less than 1.6 Tesla. The saturation induction $B_s$ is defined as the magnetic induction B at its magnetic saturation when a magnetic material is under excitation with an applied field H. Compared with a $B_s$ of ~2 Tesla for a conventional grain-oriented silicon-steel, the lower saturation inductions of the amorphous alloys lead to an increased transformer core size. It is thus desired that the saturation induction levels of iron-based amorphous alloys be increased to levels higher than the current levels of 1.56-1.6 Tesla.

In motors and generators, a significant amount of magnetic flux or induction is lost in the air gap between rotors and stators. It is thus desirable to use a magnetic material with a saturation induction or flux density as high as possible. A higher saturation induction or flux density in such devices means a smaller size device, which is desirable.

Magnetic switches utilized in pulse generation and compression require magnetic materials with high saturation inductions, high BH squareness ratios, defined as the ratios of the magnetic induction B at H=0 and $B_s$, low magnetic loss under AC excitation and small coercivity $H_c$, which is defined as the field at which the magnetic induction B becomes zero, and low magnetic loss under high pulse rate excitation. Although commercially available iron-based amorphous alloys have been used for such applications, namely in cores of magnetic switches for particle accelerators, $B_s$ values higher than 1.56-1.6 Tesla are desirable to achieve higher particle acceleration voltages, which are directly proportional to $B_s$ values. A lower coercivity $H_c$ and a higher BH squareness ratio mean a lower required input energy for the magnetic switch operation. Furthermore a lower magnetic loss under AC excitation increases the overall efficiency of a pulse generation and compression circuit. Thus, there is clearly needed an iron-based amorphous alloy with a saturation induction higher than $B_s$=1.6 Tesla, with $H_c$ as small as possible and the squareness ratio $B(H=0)/B_s$ as high as possible, exhibiting low AC magnetic loss in a finished magnetic core. The magnetic requirements for pulse generation and compression and actual comparison among candidate magnetic materials was summarized by A. W. Molvik and A. Faltens in Physical Review Special Topics-Accelerators and Beams, Volume 5, 080401 (2002) published by the American Physical Society.

In a magnetic inductor used as an electrical choke or a power inductor for temporary energy storage, a higher saturation induction of the core material brings about an increased current-carrying capability or a reduced device size for a given current-carrying limit. When such devices are operated under AC excitation, the core material must exhibit low core losses. Thus, a magnetic material with a high saturation induction and a low core loss under AC excitation is desirable in such applications.

In all of the above applications, which are just a few representatives of magnetic applications of a material, a high saturation induction material with a low AC magnetic loss is needed as a core material. It is thus an aspect of the present application to provide such materials based on iron-based amorphous alloys which exhibit saturation magnetic induction levels exceeding 1.6 T, and which are close to an upper limit of commercially available amorphous iron-based alloys.

Attempts were made in the past to achieve an iron-based amorphous alloy with a saturation induction higher than 1.6 T. One such example is a commercially available METGLAS®2605CO alloy with a saturation induction of 1.8 T. This alloy contains 17 at. % Co, and therefore is too expensive to be utilized in commercial magnetic products such as transformers and motors. Other examples include amorphous Fe—B—C alloys as taught in U.S. Pat. No. 4,226,619. Such alloys were found mechanically too brittle to be practically utilized. Amorphous Fe—B—Si—M alloys where M=C, as is taught in U.S. Pat. No. 4,437,907, were intended to achieve high saturation inductions, but were found to exhibit $B_s$<1.6 T.

Generally transformer loss can be reduced by increasing its physical size, which in turn increases its manufacturing cost. It would then be desirable to invent a transformer core with low magnetic loss without increasing its size. Reduction of transformer size is only possible when a transformer is operated at a higher operating magnetic flux density, which generally increases transformer loss and noise.

Thus, there is a need for smaller-sized transformers that achieve lower core loss and lower audible noise simultaneously.

SUMMARY

In accordance with aspects of the invention, an amorphous metal alloy magnetic core has a composition having a formula $Fe_aB_bSi_cC_d$ where 81.5<a≦84, 12<b<17, 1≦c<5 and 0.3≦d≦1.0, numbers being in atomic percent, with incidental impurities and (a+b+c+d) being equal to 100. When cast in a ribbon form, such an amorphous metal alloy is ductile and thermally stable, and has a saturation magnetic induction of between 1.63 and 1.66 T, and a saturation magnetostriction of 26-28 ppm. When said amorphous metal alloy is fabricated into a magnetic component, said component has low AC magnetic loss and emanates low audible noise. Such an amorphous metal alloy core is suitable for use in electric transformers, pulse generation and compression, electrical chokes, and energy-storing power inductors.

According to a first aspect of the present invention, a magnetic core is provided using an amorphous iron-based alloy having a chemical composition with a formula $Fe_aB_bSi_cC_d$ where 81.5<a≦84, 12<b<17, 1≦c<5 and 0.3≦d≦1.0, numbers being in atomic percent, with incidental impurities, simultaneously having a value of saturation magnetic induction equal to or greater than 1.63 tesla, a Curie temperature between 315° C. and 360° C. and a crystallization temperature between 400° C. and 470° C.

According to a second aspect of the present invention, the amorphous iron-based alloy is represented by the formula of: $Fe_{81.7}B_{16.0}Si_{2.0}C_{0.3}$, $Fe_{82.0}B_{16.0}Si_{1.0}C_{1.0}$, $Fe_{82.0}B_{14.0}Si_{3.0}C_{1.0}$, $Fe_{82.0}B_{13.5}Si_{4.0}C_{0.5}$, $Fe_{82.0}B_{13.0}Si_{4.0}C_{1.0}$, $Fe_{82.6}B_{15.5}Si_{1.6}C_{0.3}$, $Fe_{83.0}B_{13.0}Si_{3.0}C_{1.0}$ and $Fe_{84.0}B_{13.0}Si_{2.0}C_{1.0}$.

According to a third aspect of the present invention, the magnetic core has a saturation magnetostriction that is greater than or equal to 26 ppm and is less than or equal to 28 ppm.

According to a fourth aspect of the present invention, the magnetic core has a saturation magnetic induction that is greater than 1.65 T.

According to a fifth aspect of the present invention, the formula of the alloy is selected from one of the following formulas: $Fe_{81.7}B_{16.0}Si_{2.0}C_{0.3}$, $Fe_{82.0}B_{16.0}Si_{1.0}C_{1.0}$, $Fe_{82.0}B_{14.0}Si_{3.0}C_{1.0}$, $Fe_{82.0}B_{13.5}Si_{4.0}C_{0.5}$, and $Fe_{83.0}B_{13.0}Si_{3.0}C_{1.0}$.

According to a sixth aspect of the present invention, the alloy has been annealed at temperatures between 300° C. and 350° C.

According to a seventh aspect of the present invention, a core loss is less than or equal to 0.5 W/kg after the alloy has been annealed, when measured at 60 Hz, 1.5 tesla and at room temperature.

According to an eighth aspect of the present invention, a DC squareness ratio of the alloy is equal to or greater than 0.85 after the alloy has been annealed.

According to a ninth aspect of the present invention, the magnetic core is a magnetic core of a transformer.

According to a tenth aspect of the present invention, the magnetic core is a power inductor core.

According to an eleventh aspect of the present invention, the magnetic core is an electrical choke.

According to a twelfth aspect of the present invention, the magnetic core is an inductor core of a magnetic switch in a pulse generator and/or compressor.

According to another aspect of the present invention, the magnetic core emanates, when used as an inductor in transformers, electrical choke coils or energy storing power devices, an audible noise that has a magnitude that is less than a magnitude of an audible noise that emanates from a second core that fails to include an amorphous iron-based alloy comprising: a chemical composition with a formula $Fe_aB_bSi_cC_d$ where 81.5<a≦84, 12<b<17, 1≦c<5 and 0.3≦d≦1.0, numbers being in atomic percent, with incidental impurities, simultaneously having a value of saturation magnetic induction equal to or greater than 1.63 tesla, a Curie temperature between 315° C. and 360° C. and a crystallization temperature between 400° C. and 470° C.

According to yet another aspect of the present invention, the magnetic core is an inductor in a transformer that emanates audible noise that is about 5 dB less than an audible noise emanating from the second core.

According to one other aspect of the present invention, a magnetic core is provided, utilizing an amorphous iron-based alloy comprising: a chemical composition with a formula $Fe_aB_bSi_cC_d$ where 81.5<a≦84, 12<b<17, 1≦c<5 and 0.3≦d≦1.0, numbers being in atomic percent, with incidental impurities, simultaneously having a value of saturation magnetic induction equal to or greater than 1.63 tesla and a saturation magnetostriction that is greater than or equal to 26 ppm and is less than or equal to 28 ppm.

According to still another aspect of the prevent invention, a magnetic core is provided, utilizing an amorphous iron-based alloy comprising: a chemical composition with a formula $Fe_aB_bSi_cC_d$ where 81.5<a≦84, 12<b<17, 1≦c<5 and 0.3≦d≦1.0, numbers being in atomic percent, with incidental impurities, simultaneously having a value of saturation magnetic induction equal to or greater than 1.63 tesla and having a core loss that is less than or equal to 0.5 W/kg after the alloy has been annealed, when the core loss is measured at 60 Hz, 1.5 tesla and at room temperature.

Additional aspects and/or advantages of the invention will be set forth in part in the description which follows and, in part, will be obvious from the description, or may be learned by practice of the invention.

BRIEF DESCRIPTION OF THE DRAWINGS

Various aspects and advantages of the invention will become apparent and more readily appreciated from the following description of the embodiments, taken in conjunction with the accompanying drawings of which.

DETAILED DESCRIPTION OF EMBODIMENTS

Figure 1:
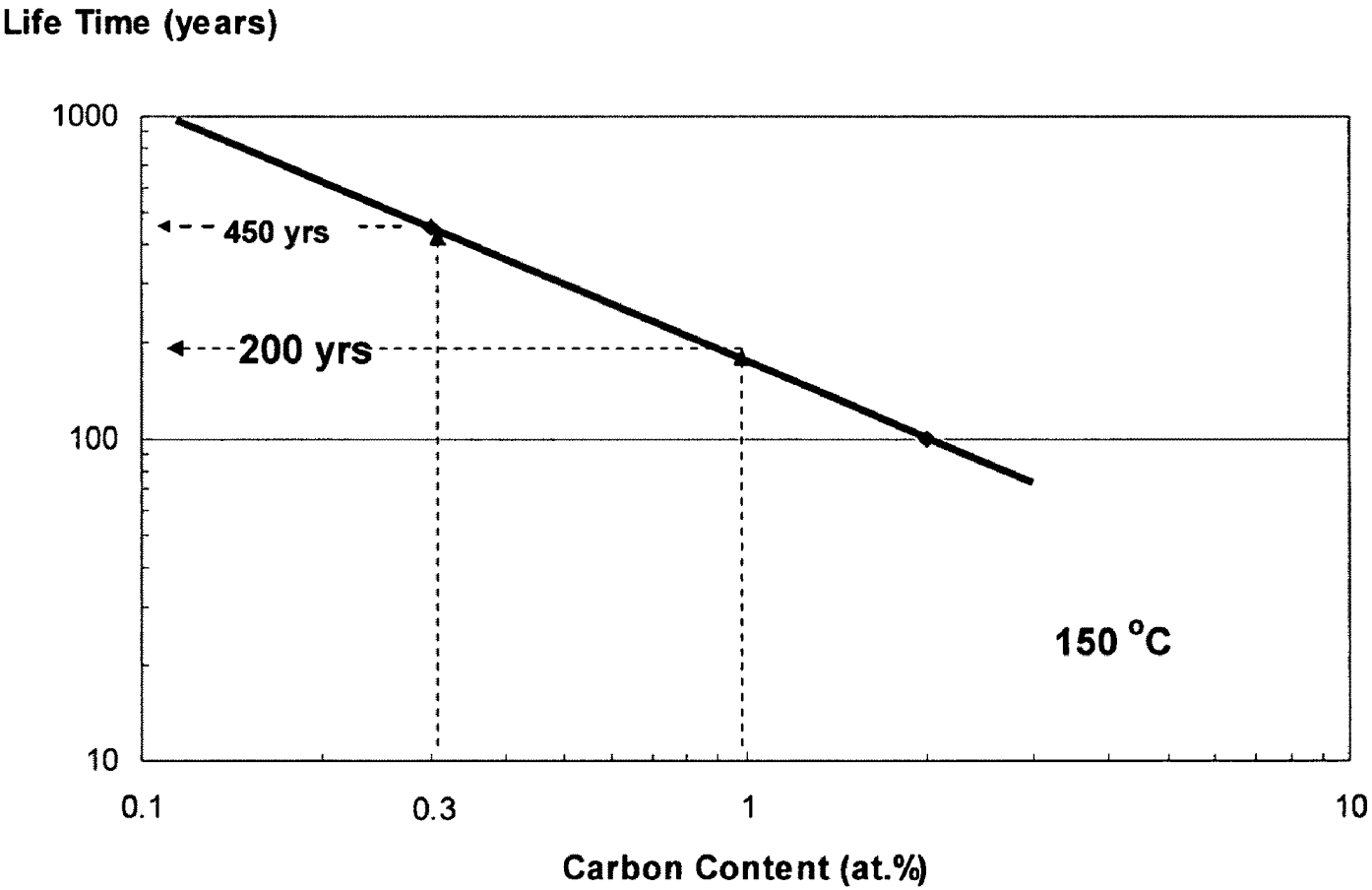
FIG. 1 shows the lifetime as a function of carbon content for magnetic cores based on amorphous Fe—B—Si—C alloys with an Fe content of about 82 at. % and a boron content of about 16 at. % when a magnetic device is operated at 150° C.

Reference will now be made in detail to the embodiments of the present invention, examples of which are illustrated in the accompanying drawings, wherein like reference numerals refer to the like elements throughout. The embodiments are described below to explain the present invention by referring to the figures.

In accordance with aspects of the invention, an amorphous metal alloy magnetic core has a composition having a formula $Fe_aB_bSi_cC_d$ where $81.5<a\leqq84$, $12<b<17$, $1\leqq c<5$ and $0.3\leqq d\leqq1.0$, numbers being in atomic percent, with incidental impurities and (a+b+c+d) being equal to 100. When cast in a ribbon form, such an amorphous metal alloy is ductile and thermally stable, and has a saturation magnetic induction of between 1.63 and 1.66 T, and a saturation magnetostriction of 26-28 ppm. When said amorphous metal alloy is fabricated into a magnetic component, said component has low AC magnetic loss and emanates low audible noise. Such an amorphous metal alloy core is suitable for use in electric transformers, pulse generation and compression, electrical chokes, and energy-storing power inductors.

It is known that the saturation magnetostriction, $\lambda_s$, of Fe-based amorphous alloys increases with the saturation induction, $B_s$, following the relation $\lambda_s=k\ B_s^2$ with k as a proportionality constant which depends on the Fe-based amorphous alloy systems, formulated by S. Ito et al., in *Applied Physics Letters*, vol. 37, p. 665 (1980). In Fe—B—Si based alloy systems k is about 11 ppm/tesla$^2$, as determined from $B_s$=1.56 T and $\lambda_s$=27 ppm for Fe—B—Si based commercially available METGLAS® 2605SA1 alloy. It is thus expected that an amorphous Fe—B—Si based alloy with $B_s$>1.6 T would have $\lambda_s$>28 ppm.

Magnetostriction is a magnetoelastic phenomenon, the quantity of which is defined as the material's length change upon magnetization of a magnetic material. Thus, magnetostriction introduces audible noise when the magnetic material is used in a magnetic device operated under AC excitation. Such noise is exemplified by the familiar humming of utility transformers. Clearly, it is desirable to have quiet transformers. Thus, the need for quiet transformers corresponds to the need of a magnetic core material with a low magnetostriction. Since a high $B_s$ value generally leads to a high $\lambda_s$ value as stated above, it is expected that increase in $B_s$ value results in noisier transformer.

Contrary to this expectation, the present application provides a magnetic core material with a high saturation magnetic induction $B_s$ value and a low saturation magnetostriction $\lambda_s$ value in an amorphous Fe-based alloy. This is a surprising and unexpected discovery.

The ductile iron-based amorphous alloys of the present application have a saturation magnetic induction exceeding 1.6 T, and also have a saturation magnetostriction exceeding as little as possible above a 27 ppm level, having low AC magnetic losses and high magnetic stability at devices' operating temperatures. Such a core material brings about a smaller size core, and a magnetic device utilizing a core with such properties exhibits a low AC magnetic loss and a low audible noise.

Core loss is a parameter that measures the efficiency of an alloy used as an electromagnetic device. In addition to compositions, annealing conditions of the alloys affect the core loss values. In general, the amorphous alloy of the present application exhibits low core loss at 0.5 W/kg or less when measured at 60 Hz, under 1.5 telsa and at room temperature after the alloy has been annealed.

Reference will now be made in detail to the embodiments of the present invention, examples of which are illustrated in the accompanying drawings, wherein like reference numerals refer to the like elements throughout. The embodiments are described below to explain the present invention by referring to the figures.

An amorphous alloy magnetic core, in accordance with embodiments of the present invention, is characterized by a combination of a high saturation magnetic induction $B_s$ exceeding 1.6 T, a low AC core loss, a low saturation magnetostriction and a high thermal stability. The amorphous alloy has a chemical composition having a formula $Fe_aB_bSi_cC_d$, where $81.5<a\leqq84$, $12<b<17$, $1\leqq c<5$ and $0.3\leqq d\leqq1.0$, numbers being in atomic percent, with incidental impurities and (a+b+c+d) being equal to 100.

Iron provides high saturation magnetic induction in a material below the material's Curie temperature at which magnetic induction becomes zero. Accordingly, an amorphous alloy with a high iron content with a high saturation induction is desired. However, in an iron-rich amorphous alloy system, a material's Curie temperature decreases with the iron content as shown by R. Hasegawa and Rangan Ray in *Journal of Applied Physics*, vol. 49, p. 4174 (1978) published by American Institute of Physics. Thus, at room temperature a high concentration of iron in an amorphous alloy does not always result in a high saturation magnetic induction $B_s$. Thus, a chemical compositional optimization is necessary, as is set forth in accordance with embodiments of the present invention as described herein.

An alloy, with chemical composition of $Fe_aB_bSi_cC_d$ where a exceeds 81.5 and is less than or equal to about 84, b is between 12 and 17, c is from greater than or equal to 1 and less than 5, and d is greater than or equal to 0.3 and less than or equal to 2 was readily cast into an amorphous state by using a rapid solidification method described in U.S. Pat. No. 4,142,571, the contents of which are incorporated herein by reference. The as-cast alloy is in a ribbon form and ductile. Typical examples of the magnetic and thermal properties of the amorphous alloys thus cast are given in Table I below:

In Table I, saturation magnetic induction, saturation magnetostriction, Curie and crystallization temperatures of the amorphous alloys having compositions of $Fe_aB_bSi_cC_d$ are set forth, where a exceeds 81.5 and is less than or equal to 84, b is between 12 and 17, c is greater than or equal to 1 and less than 5 and d is greater than or equal to 0.3 and less than or equal to 2.

TABLE I

Saturation Magnetic Induction, Saturation Magnetostriction, Curie Temperature, and Crystallization Temperature of the Amorphous Alloys for Embodiments of the Present Invention

| Composition (at. %) | Saturation Magnetic Induction (Tesla) | Saturation Magnetostriction (ppm) | Curie Temperature (° C.) | Crystallization Temperature (° C.) |
|---|---|---|---|---|
| $Fe_{81.7}B_{16.0}Si_{2.0}C_{0.3}$ | 1.65 | 27 | 359 | 466 |
| $Fe_{82.6}B_{15.5}Si_{1.6}C_{0.3}$ | 1.64 | 28 | 348 | 444 |
| $Fe_{82.0}B_{13.5}Si_{4.0}C_{0.5}$ | 1.65 | 27 | 359 | 453 |
| $Fe_{82.0}B_{16.0}Si_{1.0}C_{1.0}$ | 1.66 | 28 | 353 | 451 |
| $Fe_{82.0}B_{14.0}Si_{3.0}C_{1.0}$ | 1.66 | 27 | 356 | 448 |
| $Fe_{82.0}B_{13.0}Si_{4.0}C_{1.0}$ | 1.64 | 27 | 358 | 450 |
| $Fe_{83.0}B_{13.0}Si_{3.0}C_{1.0}$ | 1.65 | 26 | 336 | 426 |
| $Fe_{84.0}B_{13.0}Si_{2.0}C_{1.0}$ | 1.63 | 26 | 315 | 401 |
| $Fe_{82.0}B_{14.0}Si_{2.0}C_{2.0}$ | 1.66 | 27 | 355 | 444 |

All such alloys have saturation magnetic inductions, $B_s$, exceeding 1.6 T, ranging from about 1.63 T to about 1.66 T, saturation magnetostriction, $\lambda_s$, ranging from about 26 ppm to about 28 ppm, Curie temperatures exceeding 300° C., ranging from about 315° C. to about 360° C., and crystallization temperatures exceeding 400° C., ranging from about 400° C. to 470° C. The saturation induction levels of 26-28 ppm exhibited by the amorphous alloys for embodiments of the present invention are lower than the saturation induction levels that are >28 ppm, which are expected from the amorphous alloys with a $B_s$>1.6 T as discussed in paragraph.

Since most of the magnetic devices commonly used are operated below 150° C., at which electrically insulating materials used in such devices burn or deteriorate rapidly, the amorphous alloys in Table I remain in amorphous states below their temperatures of use which are well below the materials' crystallization temperatures, which are above 400° C. Although the amorphous alloys of Table I remain amorphous structurally, their long-term thermal stability needed to be examined. A supporting evidence for the long-term thermal stability was obtained through accelerated aging tests in which core loss and exciting power at elevated temperatures above 250° C. were monitored over several months until the values started to increase. The time period at which the property increase was recorded at each aging temperature was plotted as a function of $1/T_a$, where $T_a$ was the aging temperature on the absolute temperature scale. The plotted data are best described by the following formula:

$$\tau=\tau_o\exp(-E_a/k_BT),$$

where $\tau$ is the time for an aging process to be completed at temperature T, $\tau_o$ is a characteristic time associated with the kinetic process involved, $E_a$ is the activation energy for the aging process, and $k_B$ is the Boltzmann constant. The data plotted on a logarithmic scale were extrapolated to the temperatures pertinent to the operating temperatures of widely used magnetic devices, such as transformers. Such plotting is known as an Arrhenius plot and is widely known in the industry to predict long-term thermal behavior of a material. An operating temperature of 150° C. was selected because most of the electrical insulating materials used in such magnetic devices either burn or deteriorate rapidly above about 150° C.

Table II shows the results of the study made on two representative alloys containing the lowest and highest amount of C from Table I. It was found that the lifetime of the amorphous alloys depends on the C content in the amorphous alloys examined. In light of occasional incidences in which the operating temperatures of a magnetic device exceed 150° C., a lifetime of 100 years for the amorphous alloy containing 2 at. % C may not be long enough. Thus it is desirable to reduce the C content to below 2 at. %, considering a safety factor requirement to be met for some magnetic devices. Since the thermal properties of the amorphous alloys of Table I are governed by the exponential function given above, a logarithmic plot of the lifetime of the amorphous alloys examined is justified to predict the lifetime of the amorphous alloys containing C between 0.3 and 2.0 atom %. Such a plot is shown in FIG. 1, which indicates that a 1 at. % C containing amorphous alloy is estimated to be thermally stable for about 200 years at 150° C. Thus, a 1 at. % C containing amorphous alloy is expected to function twice as long as a 2 at. % C containing alloy under a continuous operating temperature of 150° C., and thus, is preferred. Thus, a carbon content between 0.3 at. % and 1.0 at. % is preferred.

TABLE II

Lifetime of an amorphous alloy core according to embodiments of the present invention at 150° C.

| Alloy | Lifetime (years) |
|---|---|
| $Fe_{81.7}B_{16.0}Si_{2.0}C_{0.3}$ | 450 |
| $Fe_{82.0}B_{14.0}Si_{2.0}C_{2.0}$ | 100 |

Comparison of the BH behaviors of the amorphous alloys in accordance with embodiments of the present invention and that of a commercially available iron-based amorphous alloy shows unexpected results. As is clearly seen in FIG. 2 in which the BH loops are compared, the magnetization toward saturation is much sharper in the amorphous alloy in embodiments of the present invention than that in a commercially available amorphous iron-based METGLAS®2605SA1 alloy. The consequence of such differences is a reduced magnetic field needed to achieve a predetermined induction level in the alloy core of embodiment of the present invention than the magnetic field needed to achieve such an induction level in the commercially available alloy core, as is shown in FIG. 3.

Figure 2:
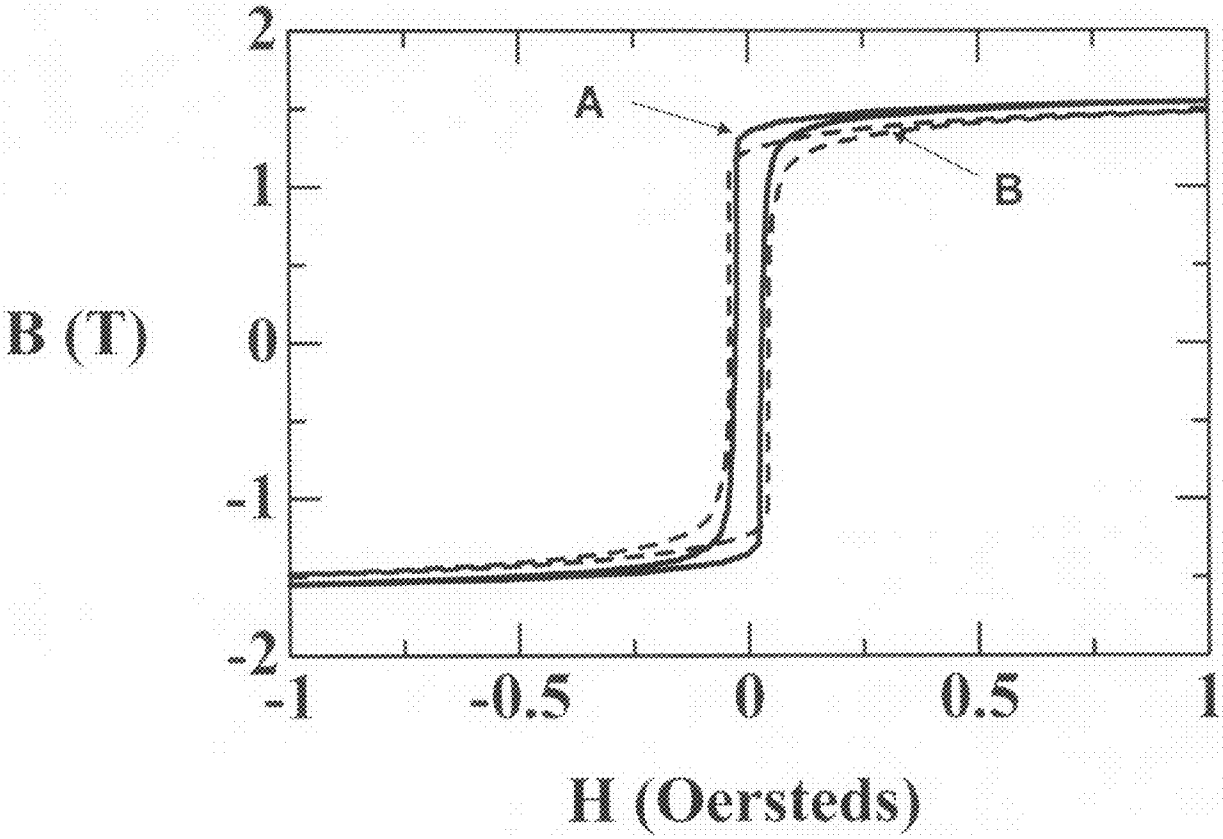
FIG. 2 illustrates a graphical representation with respect to coordinates of magnetic induction B and applied field H of up to 1 Oe (80 A/m), that compares the BH behaviors of an amorphous alloy core annealed at 320° C. for one hour in a DC magnetic field of 20 Oe (1600 A/m) and having a composition of $Fe_{81.7}B_{16.0}Si_{2.0}C_{0.3}$ of embodiments of the present invention, shown by curve A, with that of a commercially available iron-based amorphous METGLAS®2605SA1 alloy core, shown by curve B, annealed at 360° C. for 2 hours in a DC magnetic field of 30 Oe (2400 A/m)
Figure 3:
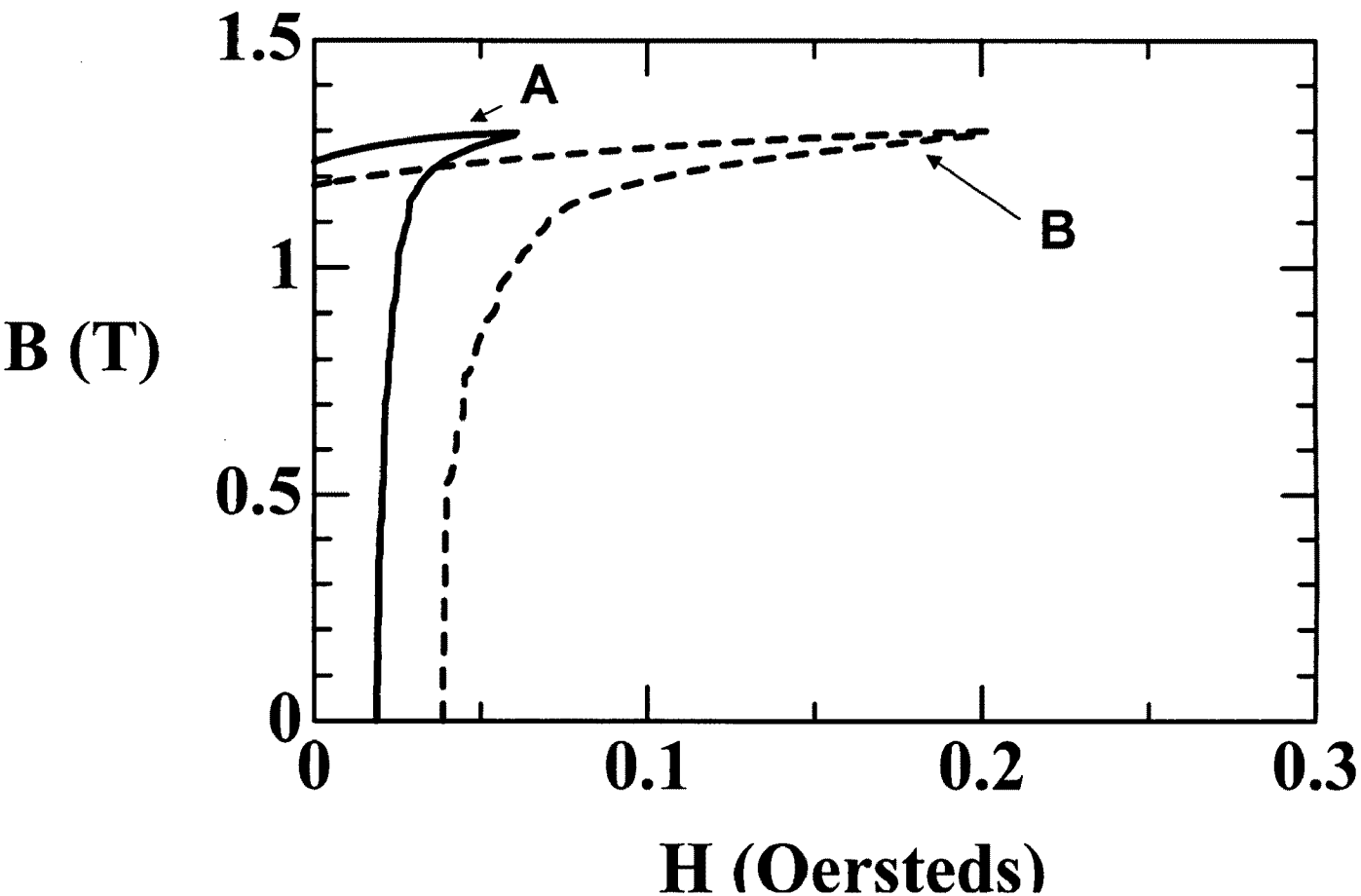
FIG. 3 illustrates a graphical representation with respect to coordinates of magnetic induction B and applied field H, that depicts the first quadrant of the BH curves of FIG. 2 up to the induction level of 1.3 Tesla with curve A and B, each referring to the same in FIG. 2.
Figure 4:
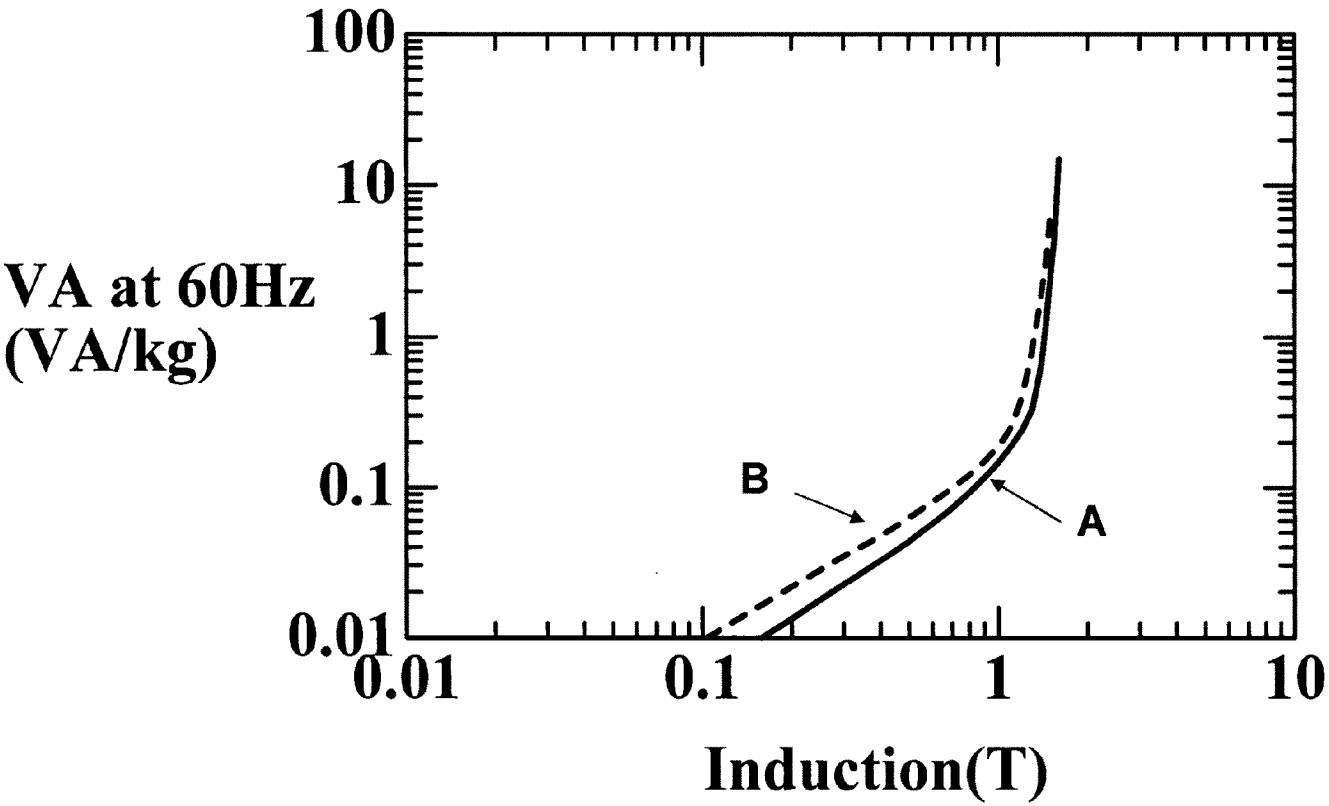
FIG. 4 illustrates a graphical representation with respect to coordinates of exciting power VA at 60 Hz and induction level B, that compares the exciting power of an amorphous alloy core annealed at 320° C. for one hour in a DC magnetic field of 20 Oe (1600 A/m) and having a composition of $Fe_{81.7}B_{16.0}Si_{2.0}C_{0.3}$ of embodiments of the present invention, shown by curve A, with that of a commercially available iron-based amorphous alloy METGLAS®2605SA1, shown by curve B, annealed at 360° C. for two hours in a DC magnetic field of 30 Oe (2400 A/m).

In FIG. 3, the excitation level was set at 1.3 Tesla, and the magnetic fields needed to achieve such an excitation level were determined for an amorphous alloy in accordance with embodiments of the present invention and for a prior art amorphous alloy, METGLAS®2605SA1. It is clearly demonstrated that the amorphous alloy for embodiments of the present invention requires a much smaller magnetic field of about 0.06 Oe (4.8 A/m) than the magnetic field of 0.2 Oe (16 A/m) which is required for the Metglas®2605SA1 alloy, and hence, less exciting current is required to achieve a same magnetic induction for the present invention compared with the exciting current required for the commercially available alloy. This is shown in FIG. 4 where the exciting power, which is a product of the exciting current of the primary winding of a transformer core and the voltage at the secondary winding of the same transformer core, of the two amorphous alloys of FIGS. 2 and 3 is compared. It is clear that the exciting power for the amorphous alloy core in accordance with embodiments of the present invention is lower at any excitation level than that of a commercially available METGLAS®2605SA1 alloy core.

Lower exciting power in turn results in a lower core loss for the alloys in accordance with embodiments of the present invention than for the commercially available amorphous alloy, especially at high magnetic excitation levels. Typical examples of core loss at high excitation are given in Table III for an amorphous alloy of embodiments of the present invention showing $B_s$=1.65 T in Table I and a commercially available amorphous alloy, METGLAS®2605SA1.

In Table III, core loss is compared at different induction levels between B=1.3 and 1.5 T between a high saturation induction alloy for embodiments of the present invention and a commercially available amorphous iron-based alloy METGLAS®2605SA1. The measurements in accordance with the ASTM Standards listed in Example IV were performed on the toroidal cores prepared following Example III and heat-treated at 320° C. for one hour in a DC field of 20 Oe (1600 A/m) for the amorphous alloy of embodiments of the present invention and at 360° C. for two hours in a DC field of 30 Oe (2400 A/m) for the commercially available alloy.

TABLE III

Core Loss Comparison at different induction levels between B = 1.3 and 1.5 T between a high saturation induction alloy for embodiments of the present invention and a commercially available amorphous iron-based alloy METGLAS ® 2605SA1. The measurements in accordance with the ASTM Standards listed in Example IV were performed on the toroidal cores prepared following amorphous alloy of embodiments of the present invention and at 360° C. for two hours in a DC filed of 30 Oe (1600 A/m) for the commercially available alloy.

| | Core Loss at 60 Hz (W/kg) | | | |
|---|---|---|---|---|
| Alloy | B = 1.3 T | B = 1.4 T | B = 1.45 T | B = 1.5 T |
| $Fe_{81.7}B_{16.0}Si_{2.0}C_{0.3}$ | 0.24 | 0.29 | 0.33 | 0.38 |
| METGLAS ® 2605SA1 | 0.27 | 0.32 | 0.35 | n/a |

n/a: cores could not be excited at this level due to the fact B = 1.5 T is too close to the saturation induction (=1.56 T) of METGLAS ® 2605SA1 alloy.

As expected and seen in Table III, core loss of a commercial amorphous alloy METGLAS®2605SA1 increases rapidly above 1.45 T induction because the alloy has a saturation induction $B_s$=1.56 T and cannot be excited above about 1.5 Tesla. Thus, no data point for B=1.5 T is given in Table III for the METGLAS®2605SA1 alloy. The amorphous alloy in accordance with embodiments of the present invention, on the other hand, shows lower core loss than that of the commercially available alloy and can be excited beyond 1.45 T, as indicated in Table III, because the amorphous alloy has a higher saturation induction of 1.65 T than saturation induction of the commercial amorphous alloy.

To determine the optimum range for the magnetic field strengths during annealing of a core of the present invention, the field strength was varied from about 0 to 30 Oe (2400 A/m). The results are given in Table IV.

TABLE IV

Core loss for toroidal cores with OD = 30.5 mm, ID = 22.2 mm and HT = 25.4 mm annealed at 340° C. for 2 hours with an annealing field strength, $H_a$.

| $H_a$ | Core Loss (W/kg) at Induction B (tesla) | | | | | | | | |
|---|---|---|---|---|---|---|---|---|---|
| (Oe) | 1.0 T | 1.1 T | 1.2 T | 1.3 T | 1.35 T | 1.4 T | 1.45 T | 1.5 T | 1.55 T |
| 0 | 0.18 | 0.23 | 0.3 | 0.38 | 0.41 | 0.26 | 0.46 | 0.49 | 0.53 |
| 2 | 0.12 | 0.14 | 0.17 | 0.20 | 0.21 | 0.23 | 0.24 | 0.27 | 0.30 |
| 5 | 0.12 | 0.14 | 0.17 | 0.20 | 0.22 | 0.23 | 0.25 | 0.27 | 0.30 |
| 10 | 0.14 | 0.16 | 0.19 | 0.22 | 0.24 | 0.25 | 0.27 | 0.29 | 0.32 |
| 30 | 0.13 | 0.16 | 0.18 | 0.22 | 0.23 | 0.24 | 0.26 | 0.28 | 0.30 |

Table IV above indicates that an annealing field between 2 Oe (160 A/m) and 30 Oe (2400 A/m) is sufficient to attain a desired level of core loss in a magnetic core of the present invention.

The unexpected sharpness of the BH behavior shown in FIG. 2 and FIG. 3 for the amorphous alloy cores of embodiments of the present invention are suited for use as inductors in magnetic switches for pulse generation and compression. It is clear that an amorphous alloy in accordance with embodiments of the present invention has a higher saturation induction $B_s$, a lower coercivity and a higher BH squareness ratio than the commercial alloy. The higher level of $B_s$ of the alloy in accordance with embodiments of the present invention is especially suited to achieve a larger flux swing which is given by $2B_s$. As explained in the next paragraph, a magnetic switch becomes effective when a large flux swing is achieved in a core with low coercivity and a high squareness ratio. Values of DC coercivity, a DC BH squareness ratio and $2B_s$ are compared in Table V.

Table V shows data taken by a BH loop tracer of Example IV on toroidal cores made from an amorphous alloy of embodiments of the present invention and the commercially available METGLAS®2605SA1alloy following the procedure described in Example III. $Fe_{81.7}B_{16.0}Si_{2.0}C_{0.3}$ examples −1, −2, −3, −4 and $Fe_{82.0}B_{13.5}Si_4C_{0.5}$, $Fe_{82.0}B_{16.0}Si_{1.0}C_{1.0}$, $Fe_{82.0}B_{14.0}Si_{3.0}C_{1.0}$, and $Fe_{82.0}B_{13.0}Si_{4.0}C_{1.0}$ were heat-treated at 340° C. for 2 hours, the $Fe_{81.7}B_{16.0}Si_{2.0}C_{0.3}$−4 alloy was heat-treated at 320° C. for 3 hours, respectively, and the METGLAS 2605SA1 alloy was heat-treated at 360° C. for 2 hours, all being in a magnetic field of 30 Oe (2400 A/m) applied along the cores' circumference direction. The squareness ratio given is defined by $B_r/B_1$, where $B_r$ is the remanence (H=0 Oe), and $B_1$ is the induction at H=1 Oe (80 A/m) (see FIG. 2).

TABLE V

Data Taken by a BH Loop Tracer of Example IV on Toroidal Cores made from an amorphous alloy of embodiments of the present invention and the commercially available METGLAS ® 2605SA1 alloy following the procedure described in Example III

| Alloy | Coercivity (Oe) | Squareness Ratio ($B_r/B_1$) | $2B_s$ (Tesla) |
|---|---|---|---|
| $Fe_{81.7}B_{16.0}Si_{2.0}C_{0.3}$-1 | 0.030 | 0.85 | 3.30 |
| $Fe_{81.7}B_{16.0}Si_{2.0}C_{0.3}$-2 | 0.043 | 0.90 | 3.30 |
| $Fe_{81.7}B_{16.0}Si_{2.0}C_{0.3}$-3 | 0.043 | 0.95 | 3.30 |
| $Fe_{81.7}B_{16.0}Si_{2.0}C_{0.3}$-4 | 0.058 | 0.96 | 3.30 |
| $Fe_{82.0}B_{13.5}Si_4C_{0.5}$ | 0.033 | 0.87 | 3.28 |
| $Fe_{82.0}B_{16.0}Si_{1.0}C_{1.0}$ | 0.038 | 0.86 | 3.32 |
| $Fe_{82.0}B_{14.0}Si_{3.0}C_{1.0}$ | 0.043 | 0.86 | 3.30 |
| $Fe_{82.0}B_{13.0}Si_{4.0}C_{1.0}$ | 0.039 | 0.88 | 3.26 |
| METGLAS ® 2605SA1 | 0.043 | 0.83 | 3.12 |

From Table V, it is clear that the amorphous alloy in accordance with embodiments of the present invention exhibits a BH squareness ratio exceeding 0.83 and is more suited for use as core materials for pulse generation and compression than a commercially available amorphous alloy for the following reasons. When a material coercivity is low and its BH squareness is high, a magnetic state transition from $-B_s$ to $+B_s$ is accomplished with a small excitation energy (coercivity effect) and with little sluggishness (squareness effect). In addition, a higher $B_s$ value results in a higher output voltage in the magnetic switch. Thus, a higher $B_s$ is preferred. Furthermore, it is known that the energy stored in a magnetic switch is proportional to (core volume)×$B_s^2$. Thus, a higher $B_s$ value is preferred to realize a smaller device size.

To find optimal annealing conditions for the amorphous alloys according to embodiments of the present invention, the annealing temperature and time were changed as described in Example III. Table VI shows one such example of the results obtained for an amorphous alloy core having a composition of $Fe_{81.7}B_{16.0}Si_{2.0}C_{0.3}$ of embodiments of the present invention annealed for 1 hour with a DC magnetic field of 20 Oe (1600 A/m) applied along the ribbon's length direction and for an commercially available METGLAS®2605SA1 alloy core annealed for 1 hour with a DC magnetic field of 30 Oe (2400 A/m) applied along the ribbon's length direction. Table VI clearly indicates that the core loss of the amorphous alloy core of embodiments of the present invention is lower than that of the commercially available amorphous alloy core when the former is annealed between 300° C. and 360° C.

TABLE VI

Core Losses at 1.4 T and 60 Hz versus an Annealing Temperature for an alloy core of the embodiment of the present invention and a prior art METGLAS ® 2605SA1 alloy core

| Annealing Temperature (° C.) | Core Loss at 1.4 T and 60 Hz (W/kg) Alloy of present invention $Fe_{81.7}B_{16.0}Si_{2.0}C_{0.3}$ | Core Loss at 1.4 & and 60 Hz (W/kg) Commercially available METGLAS ® 2605SA1 |
|---|---|---|
| 320 | 0.094 | |
| 330 | 0.092 | |
| 340 | 0.089 | |
| 350 | 0.096 | |
| 360 | 0.107 | 0.129 |
| 370 | 0.137 | 0.123 |
| 380 | | 0.117 |
| 390 | | 0.114 |
| 400 | | 0.136 |

As pointed out above, the exciting power is the energy required to excite a magnetic material to a given induction level. Thus, by this definition, the exciting power is closely related to core loss of a magnetic material. The comparison of the exciting power measured on the same ribbon samples of Table VI is given graphically in FIG. 5, where Curves A and B were data for an amorphous alloy of the embodiment of the present invention and for the commercially available METGLAS® 2605SA1 alloy. Table VII gives the same data in a table format for clarification.

TABLE VII

Figure 5:
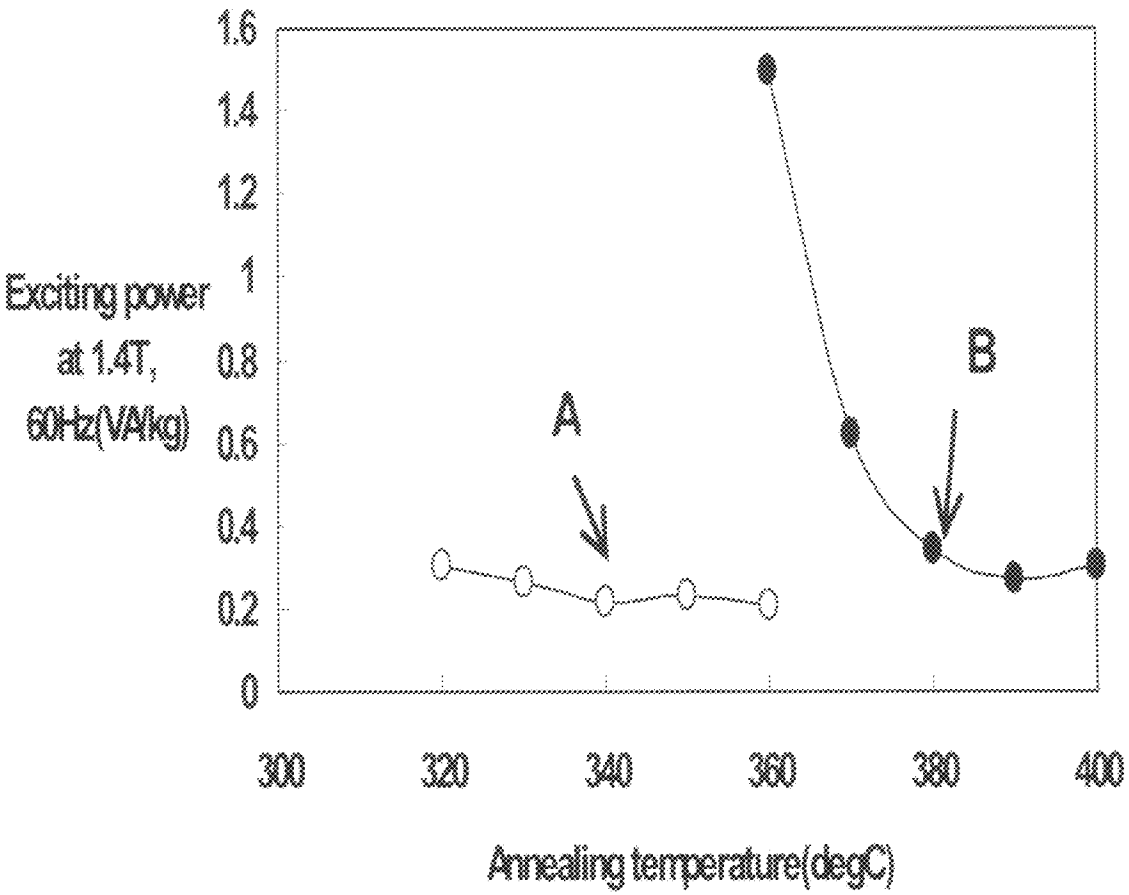
FIG. 5 shows the exciting power VA measured at 60 Hz and 1.4 T induction for an amorphous alloy ribbon strip annealed for one hour between 300° C. and 360° C. with a DC magnetic field of 30 Oe (2400 A/m) and having a composition of $Fe_{81.7}B_{16.0}Si_{2.0}C_{0.3}$, shown by curve A, of embodiments of the present invention and a ribbon strip of the commercially available METGLAS®2605SA1 alloy, shown by curve B, annealed at temperatures between 360° C. and 400° C. for one hour within a DC magnetic field of 30 Oe (2400 A/m).

Table presentation of the data of FIG. 5 showing exciting power versus annealing temperature.

| Annealing Temperature (° C.) | Exciting Power at 1.4 T and 60 Hz (VA/kg) Alloy of present invention $Fe_{81.7}B_{16.0}Si_{2.0}C_{0.3}$ | Exciting Power at 1.4 & and 60 Hz (VA/kg) Commercially available METGLAS ® 2605SA1 |
|---|---|---|
| 320 | 0.300 | |
| 330 | 0.264 | |
| 340 | 0.213 | |
| 350 | 0.228 | |
| 360 | 0.205 | 1.50 |
| 370 | | 0.621 |
| 380 | | 0.345 |
| 390 | | 0.268 |
| 400 | | 0.300 |

Reflecting the core loss data of Table VI, the exciting power of an amorphous alloy of the embodiment of the present invention was found in general, to the inventors' surprise, to be lower for the annealing temperature below 360° C. than that of a prior art alloy annealed between 360° C. and 400° C., as FIG. 5 clearly indicates. For example, at an annealing temperature of 360° C., an alloy of the embodiment of the present invention exhibited exciting power of about 0.21 VA/kg, whereas commercially available METGLAS®2605SA1 alloy exhibited an exciting power of about 1.5 VA/kg at 1.4 T and 60 Hz excitation. Such surprising results are not expected because a magnetic material with a higher saturation induction generally requires a higher exciting power to obtain a predetermined operating induction. Thus, an alloy of the embodiment of the present inventions exhibiting a saturation induction of 1.63 T-1.65 is expected to require a high exciting power to energize the core based on this alloy, contrary to the results obtained. The surprising difference was reflected in the difference in the audible noise generated from the magnetic cores based on an alloy of the embodiment of the present invention and prior art alloy METGLAS®2605SA1 as described below.

Figure 6:
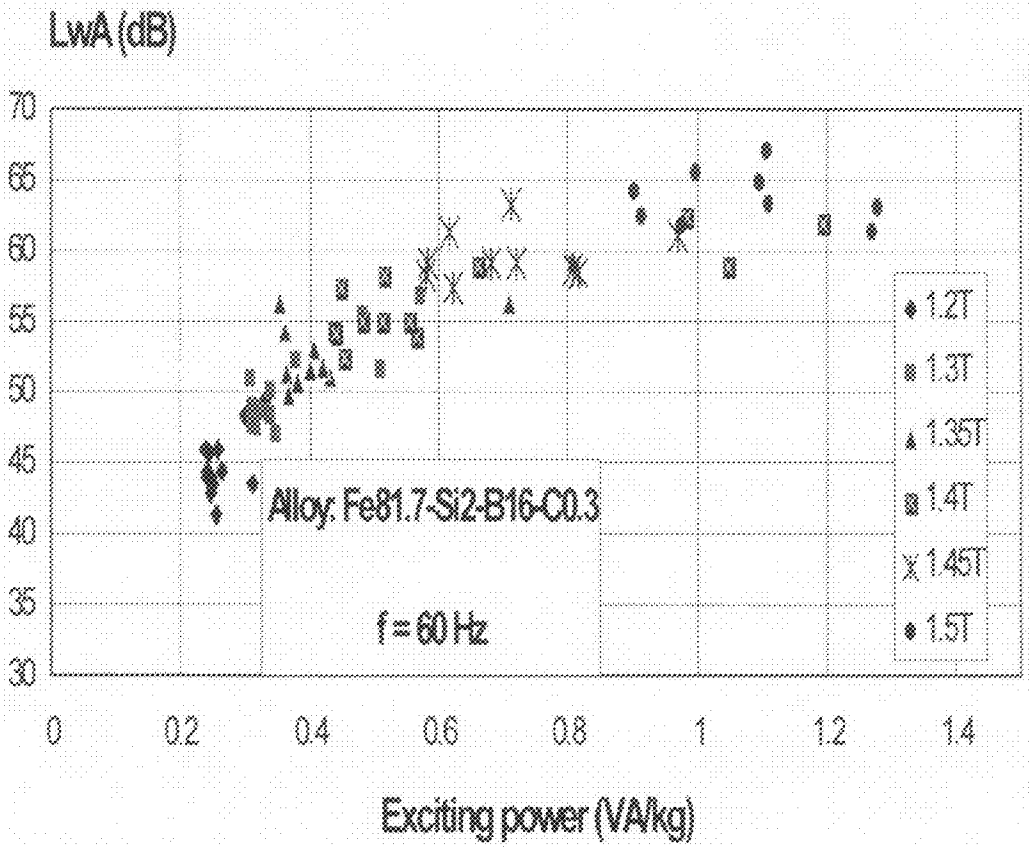
FIG. 6 shows the audible noise LwA (the sound power level) as a function of the exciting power VA measured on a core made from an amorphous alloy of the present invention with a composition of $Fe_{81.7}B_{16.0}Si_{2.0}C_{0.3}$ at 60 Hz for induction levels between 1.2 T and 1.5 T.
Figure 7:
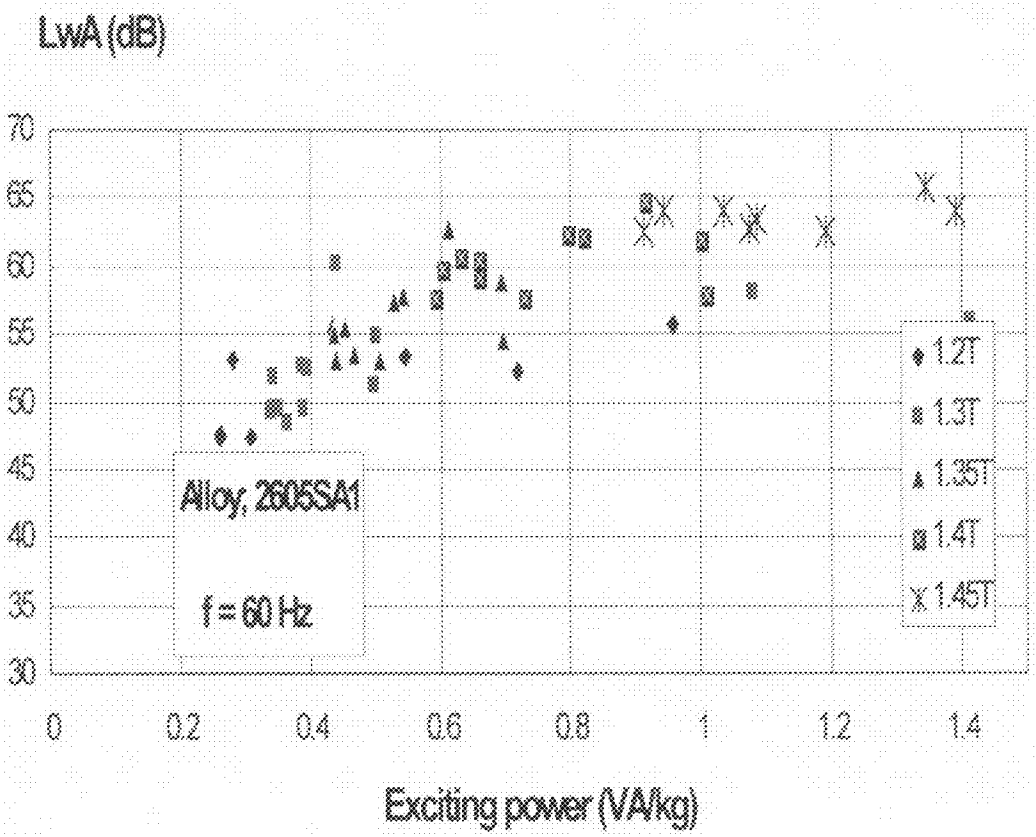
FIG. 7 shows the audible noise LwA as a function of the exciting power VA measured on a core made from a commercially available amorphous METGLAS 2605SA1 alloy at 60 Hz for induction levels between 1.2 T and 1.45 T.
Figure 8:
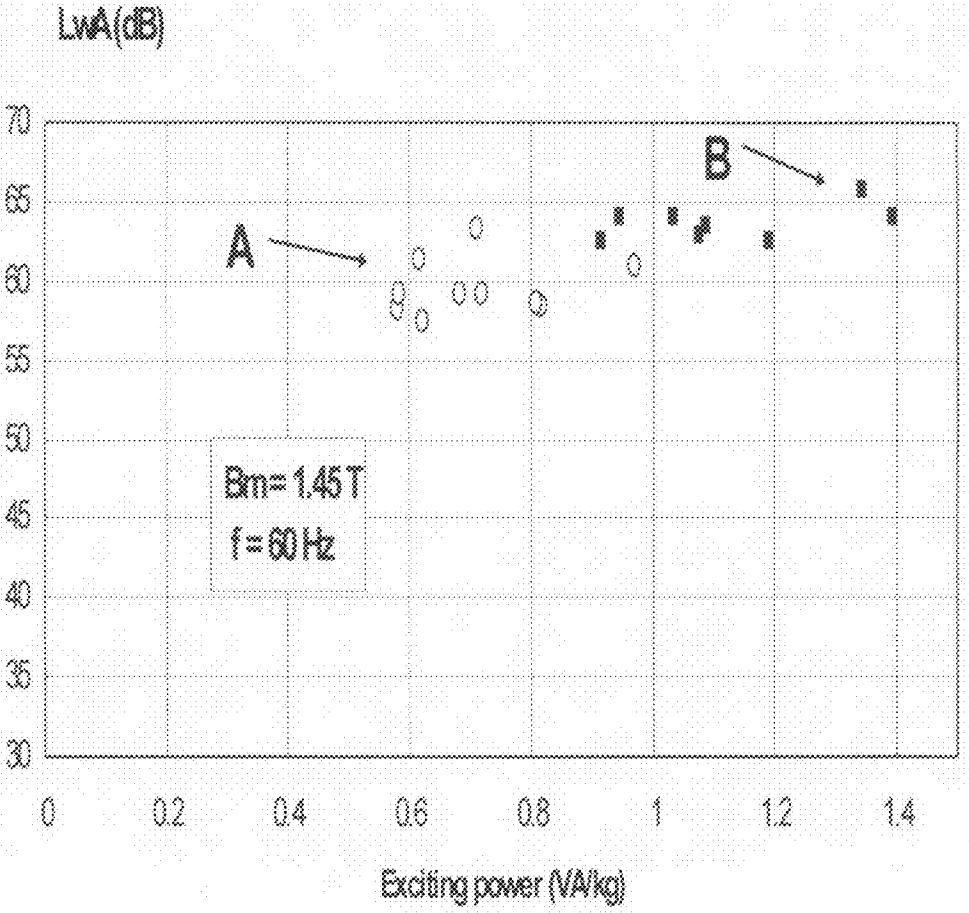
FIG. 8 shows the audible noise LwA taken at 60 Hz and induction level $B_m$=1.45 T as a function of the exciting power VA for a magnetic core made from an amorphous alloy of the present invention having a composition of $Fe_{81.7}B_{16.0}Si_{2.0}C_{0.3}$, shown by curve A and a core made from a commercially available METGLAS 2605SA1 amorphous alloy, shown by curve B.

The audible noise levels of the magnetic cores based on an alloy of the embodiment of the present invention and prior art METGLAS®2605SA1 alloy were measured as described in Example VI. FIG. 6 shows the audible noise levels as a function of the exciting power taken on an amorphous alloy core having a composition of $Fe_{81.7}Si_2B_{16}C_{0.3}$. The 60 Hz excitation was varied from 1.2 T to 1.5 T as indicated in FIG. 6. The same measurement was performed on a magnetic core based on METGLAS®2605SA1 alloy and the results are given in FIG. 7, where the 60 Hz excitation could increase to only 1.45 T. This limitation was due to the alloy's saturation induction of 1.56 T, which was lower than 1.65 T for the alloy of the embodiment of the present invention. The upper limits, 1.5 T for the alloy of the embodiment of the present invention versus 1.45 T for prior art alloy, reflect the higher saturation induction, 1.65 T, of the alloy of the embodiment of the present invention. Since both of the cores of the alloys of FIGS. 6 and 7 could be excited to 1.45 T, noise levels from the cores at 1.45 T excitation are compared in FIG. 8.

Two features are noticed in this figure: (i) The exciting power of a core of the present invention ranged from about 0.6 VA/kg to about 1 VA/kg, clustering between about 0.6 VA/kg and about 0.8 VA/kg, whereas the exciting power of a core based on prior art amorphous alloy, METGLAS®2605SA1 ranged from about 0.9 VA/kg to about 1.4 VA/kg, clustering between 0.9 VA/kg to about 1.2 VA/kg. Thus, the exciting power at 1.45 T induction at 60 Hz of a magnetic core of the present invention is, on average, lower by about 33% than that needed to excite a core based on a prior art alloy. (ii) In the respective exciting power ranges, noise levels ranged from about 57 dB to about 63 dB with an average of about 60 dB for a core of the present invention, whereas noise levels from a core of prior art alloy ranged from about 63 dB to about 66 dB, with an average of about 64.5 dB. The lower noise level from a higher saturation induction material is also unexpected because, as mentioned above, a higher saturation induction material in general emanates a higher level of noise. The noise level reduction by about 5 dB is significant in light of an increasing regulatory requirement for environmental noise reduction from electromagnetic devices such as utility transformers. Since, by definition, 1 dB corresponds to the ratio of two acoustic signal power levels equal to 10 times the common logarithm of the ratio, the noise level reduction by 5 dB means a noise reduction by 1/3.2.

Figure 9:
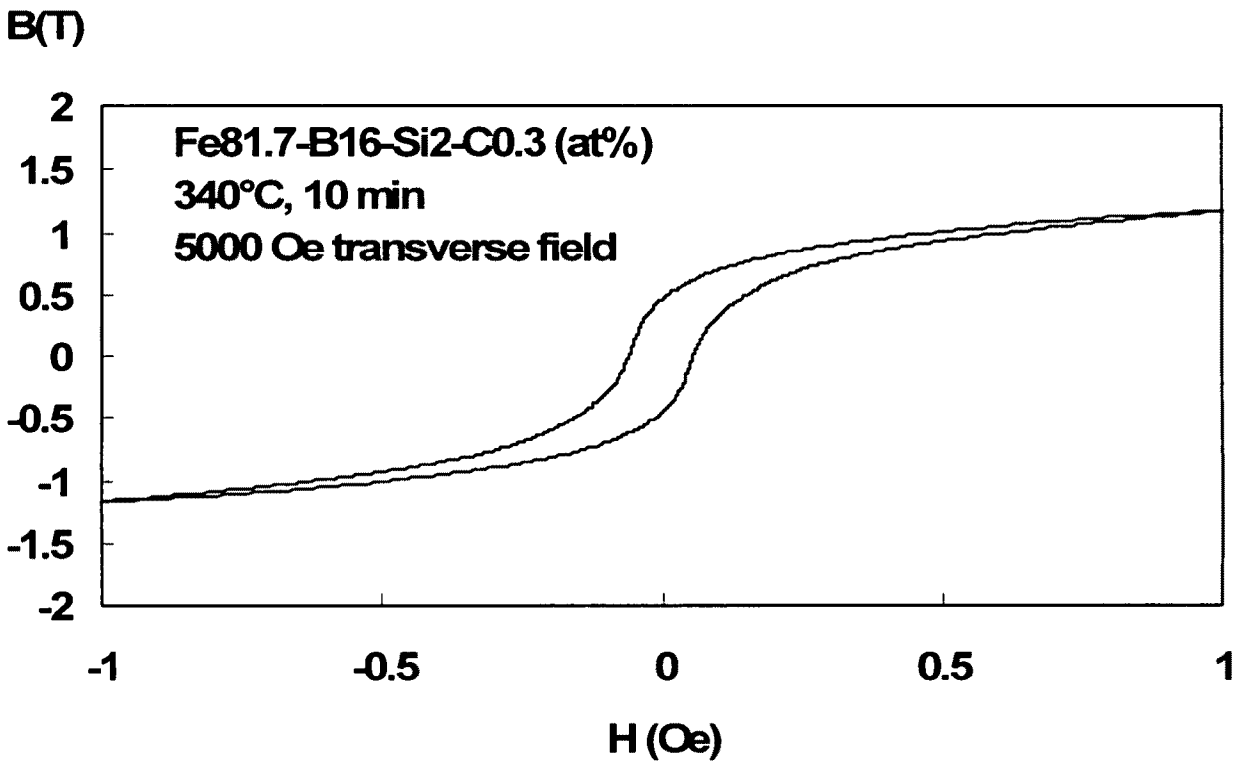
FIG. 9 shows the BH curve of an amorphous alloy core having a composition of $Fe_{81.7}B_{16.0}Si_{2.0}C_{0.3}$ of the present invention heat-treated at 340° C. for 10 min. in a transverse magnetic field of 5000 Oe (400 kA/m).

It was determined during the process of realizing a magnetic core of the embodiment of the present invention that a magnetic field was required to be applied during heat-treatment along the ribbon's length or longitudinal direction or along the circumference direction of the core with curved surfaces such as in toroidal or rectangular shaped cores to achieve all of the features, such as low AC magnetic loss and low audible noise. The magnitude of the longitudinal magnetic field was between about 2 Oe (160 A/m) and 30 Oe (2400 A/m). An annealing magnetic field applied along ribbon's width or transverse direction resulted in a sheared BH loop, as exemplified by FIG. 9. Any magnetic material exhibiting a BH loop of FIG. 9 requires a large amount of energizing current, thus increasing its exciting power, and hence, its AC core loss. These features are detrimental in a magnetic core of the present invention. Thus, an annealing magnetic field applied along ribbon's width or transverse direction or core's height direction, as taught in U.S. Pat. No. 4,763,030, is outside the scope of the present invention.

In addition to the heat-treatment requirement discussed in the above paragraph, it is vital to manufacture a core of the embodiments of the present invention so that any discrete crystalline particles are not precipitated in the amorphous alloy matrix during the heat-treatment taught in the present invention. The presence of such crystalline particles reduces core loss in a 50 kHz frequency range, as is taught in U.S. Pat. No. 4,889,568 (hereinafter, the '568 Patent), but detrimentally affects core loss at lower frequencies at which a magnetic core of the embodiments of the present invention is utilized, as is shown in Table VIII.

TABLE VIII

Core loss at 60 Hz and at 50 kHz of a magnetic core of the embodiments of the present invention heat-treated at 340° C., 365° C. and 390° C. The toroidally wound core had dimensions of ID = 22.2 mm, OD = 30.5 mm and Height = 25.4 mm.

| Heat-treatment Temperature (° C.) | Frequency (Hz) | Induction (T) | Core Loss (W/kg) |
|---|---|---|---|
| 340 | 60 | 1.5 | 0.28 |
| 340 | 50,000 | 0.1 | 78.3 |
| 365 | 60 | 1.5 | 0.59 |
| 365 | 50,000 | 0.1 | 67.8 |
| 390 | 60 | 1.5 | 5.7 |
| 390 | 50,000 | 0.1 | 16.8 |

An X-ray diffraction technique was used to detect the presence of discrete crystalline particles in the heat-treated core materials. The results showed a clear crystalline diffraction peak in the core material heat-treated at 390° C., whereas no such peak was observed in the core material heat-treated at 340° C. As Table VIII shows, the core loss at 60 Hz dramatically increased to 5.7 W/kg for the core heat-treated at 390° C. from 0.28 W/kg for the core heat-treated at 340° C. Thus, the discrete crystalline particles of the '568 Patent must not be present in the core material for the embodiments of the present invention. Such crystalline particles were introduced in a product of the '568 Patent in order to decrease core loss at frequencies near 50 kHz, as Table VIII indicates.

The following examples are presented to provide a more complete understanding of the invention. The specific techniques, conditions, materials, proportions and reported data set forth to illustrate the principles and practice of the invention according to preferred embodiments are exemplary and should not be construed as limiting the scope of the invention.

Example I

About 60 kg or more of the constituent metals, such as FeB, FeSi, Fe and C, were melted in an crucible, and the molten metal was rapidly solidified by the method described in the U.S. Pat. No. 4,142,571. The ribbon formed had a width of about 170 mm and a thickness of about 25 μm, and was tested by a conventional differential scanning calorimetry to assure its amorphous structure and determine the Curie and crystallization temperatures of the ribbon material. A conventional Archimedes' method was used to determine its mass density, so that the material's magnetic characterization could be determined. The ribbon was found to be ductile.

Example II

A piece of strip with a size of about 10 mm×2 mm cut from the ribbon of Example I was adhered onto a commercially available metallic strain gauge. The strip sample was placed in a magnetostriction measuring device described in the Review of Scientific Instrument, volume 50, p. 382 (1980). The saturation magnetostriction values of the alloys of the present invention, thus determined, are listed in Table I.

Example III

The 170 mm wide ribbon was slit into 25 mm wide ribbon, which was used to wind toroidally shaped magnetic cores weighing about 60 gram each. The cores were heat-treated at 300-370° C. for one hour in a DC magnetic field of 0 Oe (0 A/m)-30 Oe (2400 A/m) applied along the toroids' circumference direction for the alloys of embodiments of the present invention and at 360° C.-400° C. for two hours in a DC magnetic field of 10 Oe (800 A/m)-30 Oe (2400 A/m) applied along the toroids' circumference direction for the commercially available METGLAS®2605SA1 alloy. A primary copper wire winding of 10 turns and a secondary winding of 10 turns were applied on the heat-treated cores for magnetic measurements. In addition, ribbon strips of a dimension of 230 mm in length and 85 mm in width were cut from amorphous alloys of embodiments of the present invention and from the commercially available METGLAS®2605SA1 alloy and were heat-treated at temperatures between 300° C. and 370° C. for the amorphous alloy of embodiments of the present invention and between 360° C. and 400° C. for the commercially available alloy both with a DC magnetic field of about 10 Oe (800 A/m)-30 Oe (2400 A/m) applied along the strips' length direction. Some of the cores prepared above were heat-treated with a magnetic field applied along ribbon's width or transverse direction or toroidal core's height direction.

Example IV

The magnetic characterizations of the heat-treated magnetic cores with primary and secondary copper windings of Example III were performed by using commercially available BH loop tracers with DC and AC excitation capability. AC magnetic characteristics, such as core loss, were examined by following ASTM A912/A912M-04 Standards for 50/60 Hz measurements. The magnetic properties such as AC core loss of the annealed straight strips of Example III with length of 230 mm and width of 85 mm were tested by following ASTM A 932/A932M-01 Standards.

Example V

The well-characterized cores of Example III were used for accelerated aging tests at temperatures above 250° C. During the tests, the cores were in an exciting field at 60 Hz which induced a magnetic induction of about 1 T to simulate actual transformer operations at the elevated temperatures.

Example VI

Rectangular shaped transformer cores weighing about 73 kg based on an amorphous alloy of the present invention and a commercially available METGLAS®2605SA1 material were built for transformer core audible noise measurements. The noise measurements were performed in accordance with the International Standard ISO 3744:1994 E.

Although a few embodiments and examples of the present invention have been shown and described, it would be appreciated by those skilled in the art that changes may be made in these embodiments without departing from the principles and spirit of the invention, the scope of which is defined in the claims and their equivalents.

What is claimed:

1. A magnetic core utilizing an amorphous iron-based alloy according to a chemical composition with a formula $Fe_aB_bSi_cC_d$ where $81.5<a\leqq84$, $12<b<17$, $1\leqq c<5$ and $0.3\leqq d\leqq1.0$, numbers being in atomic percent with a+b+c+d=100, with incidental impurities, simultaneously having a value of saturation magnetic induction equal to or greater than 1.63 tesla, a Curie temperature between 315° C. and 360° C., a crystallization temperature between 400° C. and 470° C., and a saturation magnetostriction that is greater than or equal to 26 ppm and is less than or equal to 28 ppm, wherein the alloy has been annealed in a magnetic field applied in a direction along a circumference of the core, and the core does not contain discrete crystalline particles.

2. The magnetic core of claim 1, wherein the formula of the alloy is selected from the group consisting of: $Fe_{81.7}B_{16.0}Si_{2.0}C_{0.3}$, $Fe_{82.0}B_{16.0}Si_{1.0}C_{1.0}$, $Fe_{82.0}B_{14.0}Si_{3.0}C_{1.0}$, $Fe_{82.0}B_{13.5}Si_{4.0}C_{0.5}$, $Fe_{82.0}B_{13.0}Si_{4.0}C_{1.0}$, $Fe_{82.6}B_{15.5}Si_{1.6}C_{0.3}$, $Fe_{83.0}B_{13.0}Si_{3.0}C_{1.0}$ and $Fe_{84.0}B_{13.0}Si_{2.0}C_{1.0}$.

3. The magnetic core of claim 1, wherein the magnetic core has a saturation magnetic induction that is greater than 1.65 T.

4. The magnetic core of claim 3, wherein the formula of the alloy is selected from the group consisting of: $Fe_{81.7}B_{16.0}Si_{2.0}C_{0.3}$, $Fe_{82.0}B_{16.0}Si_{1.0}C_{1.0}$, $Fe_{82.0}B_{14.0}Si_{3.0}C_{1.0}$, $Fe_{82.0}B_{13.5}Si_{4.0}C_{0.5}$, and $Fe_{83.0}B_{13.0}Si_{3.0}C_{1.0}$.

5. The magnetic core of claim 1, wherein the alloy has been annealed at temperatures between 300° C. and 350° C.

6. The magnetic core of claim 5, wherein a core loss is less than or equal to 0.5 W/kg after the alloy has been annealed, when measured at 60 Hz, 1.5 tesla and at room temperature.

7. The magnetic core of claim 5, in which a DC squareness ratio of the alloy is equal to or greater than 0.85 after the alloy has been annealed.

8. The magnetic core of claim 6, wherein the magnetic core is a magnetic core of a transformer.

9. The magnetic core of claim 6, wherein the magnetic core is a power inductor core.

10. The magnetic core of claim 6, wherein the magnetic core is an electrical choke.

11. The magnetic core of claim 7, wherein the magnetic core is an inductor core of a magnetic switch in a pulse generator and/or compressor.

12. The magnetic core of claim 6, wherein the magnetic core emanates, when used as an inductor in transformers, electrical choke coils or energy storing power devices, an audible noise that has a magnitude that is less than a magnitude of an audible noise that emanates from a second core that fails to include an amorphous iron-based alloy comprising: a chemical composition with a formula $Fe_aB_bSi_cC_d$ where $81.5<a\leqq84$, $12<b<17$, $1\leqq c<5$ and $0.3\leqq d\leqq1.0$, numbers being in atomic percent with a+b+c+d=100, with incidental impurities, simultaneously having a value of saturation magnetic induction equal to or greater than 1.63 tesla, a Curie temperature between 315° C. and 360° C. and a crystallization temperature between 400° C. and 470° C.

13. The magnetic core of claim 12, wherein the magnetic core is an inductor in a transformer that emanates audible noise that is about 5 dB less than an audible noise emanating from the second core.

14. A magnetic core utilizing an amorphous iron-based alloy according to a chemical composition with a formula $Fe_aB_bSi_cC_d$ where $81.5<a\leqq84$, $12<b<17$, $1\leqq c<5$ and $0.3\leqq d\leqq1.0$, numbers being in atomic percent with a+b+c+d=100, with incidental impurities, simultaneously having a value of saturation magnetic induction equal to or greater than 1.63 tesla and a saturation magnetostriction that is greater than or equal to 26 ppm and is less than or equal to 28 ppm, wherein the alloy has been annealed in a magnetic field applied in a direction along a circumference of the core, and the core does not contain discrete crystalline particles.

15. A magnetic core utilizing an amorphous iron-based alloy according to a chemical composition with a formula $Fe_aB_bSi_cC_d$ where $81.5<a\leqq84$, $12<b<17$, $1\leqq c<5$ and $0.3\leqq d\leqq1.0$, numbers being in atomic percent with a+b+c+d=100, with incidental impurities, simultaneously having a value of saturation magnetic induction equal to or greater than 1.63 tesla, and a saturation magnetostriction that is greater than or equal to 26 ppm and is less than or equal to 28 ppm, and having a core loss that is less than or equal to 0.5 W/kg after the alloy has been annealed, when the core loss is measured at 60 Hz, 1.5 tesla and at room temperature, wherein the alloy has been annealed in a magnetic field applied in a direction along a circumference of the core, and the core does not contain discrete crystalline particles.

* * * * *

UNITED STATES PATENT AND TRADEMARK OFFICE

CERTIFICATE OF CORRECTION

PATENT NO. : 8,372,217 B2
APPLICATION NO. : 12/654763
DATED : February 12, 2013
INVENTOR(S) : Ryusuke Hasegawa et al.

It is certified that error appears in the above-identified patent and that said Letters Patent is hereby corrected as shown below:

Title Page, Item (54), and in the specification, Column 1, Line 3, Title, after "CORE" insert -- LOSS --.

Signed and Sealed this
Twenty-third Day of July, 2013

Teresa Stanek Rea
*Acting Director of the United States Patent and Trademark Office*